US010087690B2

(12) United States Patent
Lutgring et al.

(10) Patent No.: US 10,087,690 B2
(45) Date of Patent: Oct. 2, 2018

(54) APPARATUS AND METHOD FOR REDUCING TORQUE ON A DRILL STRING

(71) Applicant: Frank's International, LLC, Houston, TX (US)

(72) Inventors: Keith Lutgring, Lafayette, LA (US); Matthew Weber, Duson, LA (US); Burney Latiolais, Lafayette, LA (US); Ira Hining, Breaux Bridge, LA (US); Jean Buytaert, Broussard, LA (US)

(73) Assignee: Frank's International, LLC, Houston, TX (US)

( * ) Notice: Subject to any disclaimer, the term of this patent is extended or adjusted under 35 U.S.C. 154(b) by 55 days.

(21) Appl. No.: 15/222,513

(22) Filed: Jul. 28, 2016

(65) Prior Publication Data

US 2017/0030151 A1 Feb. 2, 2017

Related U.S. Application Data

(60) Provisional application No. 62/199,136, filed on Jul. 30, 2015.

(51) Int. Cl.

| | |
|---|---|
| ***E21B 17/10*** | (2006.01) |
| ***E21B 17/16*** | (2006.01) |
| ***E21B 7/04*** | (2006.01) |

(52) U.S. Cl.

CPC ..... *E21B 17/1085* (2013.01); *E21B 7/046* (2013.01)

(58) Field of Classification Search

CPC .. E21B 4/003; E21B 17/1057; E21B 17/1064; E21B 17/1085; E21B 17/16

See application file for complete search history.

(56) References Cited

U.S. PATENT DOCUMENTS 1,889,806 A * 12/1932 Lamb ..... E21B 17/1085 175/325.7
2,288,124 A * 6/1942 Creighton ..... E21B 17/1085 175/325.5
4,083,612 A * 4/1978 Olson ..... E21B 4/003 175/325.3

(Continued)

OTHER PUBLICATIONS

International Search Report and Written Opinion dated Nov. 7, 2016, in corresponding International Application No. PCT/US2016/044636 (20 pages).

*Primary Examiner* — Cathleen R Hutchins
(74) *Attorney, Agent, or Firm* — Osha Liang LLP

(57) ABSTRACT

Apparatus for reducing torque on a drill string includes a first bearing assembly, a second bearing assembly, and a bearing sleeve. The first and second bearing assemblies are disposed on and clamped onto a tubular portion of a drill pipe of the drill string, and each include a first and second section. The bearing sleeve is disposed on the drill pipe such that the bearing sleeve is maintained in an axial position relative to the drill pipe by the first bearing assembly and the second bearing assembly. Each of the first and second bearing assemblies have a first diameter portion and a second diameter portion that is smaller than the first diameter portion. The second diameter portion of the first bearing assembly and the second diameter portion of the second bearing assembly are disposed adjacent to each other and the bearing sleeve is disposed around the adjacent second diameter portions.

17 Claims, 13 Drawing Sheets

(56) References Cited

U.S. PATENT DOCUMENTS

| | | | | |
|---|---|---|---|---|
| 6,032,748 | A * | 3/2000 | DeBray | E21B 17/105 166/241.4 |
| 2002/0139537 | A1 | 10/2002 | Young et al. | |
| 2011/0114338 | A1 | 5/2011 | Casassa et al. | |
| 2011/0308784 | A1 | 12/2011 | Ollerenshaw et al. | |
| 2012/0125689 | A1* | 5/2012 | Howlett | E21B 17/105 175/57 |
| 2013/0000990 | A1* | 1/2013 | Downie | E21B 17/1085 175/325.5 |
| 2014/0000900 | A1 | 1/2014 | Leiper et al. | |
| 2015/0008042 | A1 | 1/2015 | Buytaert et al. | |
| 2015/0013997 | A1 | 1/2015 | Simpson | |

* cited by examiner

APPARATUS AND METHOD FOR REDUCING TORQUE ON A DRILL STRING

CROSS-REFERENCE TO RELATED APPLICATIONS

This application claims the benefit of U.S. Provisional Application 62/199,136 filed on Jul. 30, 2015, which is incorporated herein by reference in its entirety.

BACKGROUND

During drilling operations a drill bit is attached to the bottom end region of a drill string, and the drill bit is caused to rotate by rotation of the drill string, which is rotated by appropriate means on the drilling rig. The drill string hangs from the rig and is in tension, but in order to apply the necessary weight to cause the drill bit to bite into the earth, a bottom hole assembly is disposed just above the drill bit. The bottom hole assembly that applies weight to the drill bit is, in effect, a number of weighted drill collars.

The drill string is made up of numerous drill pipes joined end-to-end, and each of the drill pipes might be about thirty feet in length. Usually the pipes are slightly enlarged in their end regions to provide for connection components to enable one end region of a drill pipe to be connected to the adjacent end region of the adjacent drill pipe. Further, the drill pipes are hollow and thus provide a continuous channel of communication between the drill rig and the bottom of the wellbore, down through which a suitable drilling fluid can be introduced to the region around the drill bit.

Extended reach drilling, which can mean that the drill bit can be at a position several miles laterally displaced from the foot of the rig, and horizontal drilling, which is drilling where the bit is caused to follow an arcuate route and then drill a horizontal bore and is a technique used to complete wells once the bits are in the reservoir, are types of drilling commonly used in the oil-field industry. In both extended reach drilling and horizontal drilling, transmission of power from the rig to the drill bit may be hindered due to the frictional losses experienced between contact between the enlarged connected end portions of the drill pipes and the edges of the wellbore.

Often the wellbore is lined with a casing and, to protect the drill string from abrasion against the side wall of the wellbore or the casing, a drill pipe protector can be employed. The purpose of the drill pipe protector is to keep the pipe from contacting the casing or walls of the wellbore. Without a drill pipe protector, contact between the drill string and the casing and wellbore creates frictional torque and drag. A considerable amount of torque can be produced by the effects of frictional forces developed between the rotating drill pipe and the casing or the side wall of the wellbore. Thus, without a drill pipe protector, additional torque is required while rotating the drill string to overcome this resistance. In addition, the drill string is subjected to increased shock and abrasion whenever the drill string comes into contact with the side wall of the wellbore or the casing.

There have been attempts to make drill pipe protectors that are non-rotating with respect to the side wall of the wellbore or casing. In other words, drill pipe protectors may remain in fixed contact with the casing or side wall of the wellbore and not rotate with respect thereto, which means that the drill string must rotate with respect to the drill pipe protector. Rotation of a drill pipe protector with respect to the drill string may still create frictional torque and drag on the drill string. Additionally, rotation of the drill pipe protector with respect to the drill string may lead to wear and abrasions on the outer surface of the drill pipes of the drill string, and thus, may lead to a shorter life span.

SUMMARY OF DISCLOSURE

In one or more embodiments, a drill pipe protector is non-rotational with respect to a side wall of a wellbore or casing and does not bear against an outer surface of a drill pipe of a drill string. Additionally, in one or more embodiments of the present invention, an unhinged, single-piece outer sleeve of a drill pipe protector alleviates a risk of the outer sleeve getting lost in the wellbore.

In one or more embodiments, an apparatus for reducing torque on a drill string may include a first bearing assembly disposed on a tubular portion having a first outer diameter, of a drill pipe of the drill string, and the first bearing assembly may include a plurality of sections coupled together such that the first bearing assembly clamps onto the tubular portion of the drill pipe. The apparatus may further include a second bearing assembly disposed adjacent to the first bearing assembly on the tubular portion of the drill pipe of the drill string, and the second bearing assembly may include a plurality of sections coupled together such that the second bearing assembly clamps onto the tubular portion of the drill pipe. Additionally, a bearing sleeve may be disposed on the drill pipe of the drill string such that the bearing sleeve is maintained in an axial position relative to the drill pipe by the first bearing assembly and the second bearing assembly. Further, each of the first bearing assembly and the second bearing assembly may include a first portion having a first diameter and a second portion having a second diameter that is smaller than the first diameter. Furthermore, the second portion of the first bearing assembly and the second portion of the second bearing assembly may be adjacent to each other. Moreover, the bearing sleeve may be disposed around the second portion of the first bearing assembly and the second portion of the second bearing assembly.

In one or more embodiments, a method of assembling an apparatus about a tubular portion having a first outer diameter of a drill pipe may include sliding a bearing sleeve over an end of a drill pipe of a drill string. The end of the drill pipe may have a tool joint having a second outer diameter that is larger than the first outer diameter. Further, the method may include clamping a first bearing assembly on a tubular portion of the drill pipe, and the first bearing assembly may have a plurality of sections coupled together. Furthermore, the method may include sliding the bearing sleeve, which has an outer diameter larger than the second outer diameter of the drill pipe, axially over the drill pipe until the bearing sleeve contacts the first bearing assembly. Additionally, the method may include clamping a second bearing assembly, which has a first section and a second section coupled together, on the tubular portion of the drill pipe such that the bearing sleeve is pressed between the first bearing assembly and the second bearing assembly and maintained in a fixed axial position relative to the drill pipe.

In one or more embodiments, a system for reducing torque on a drill string may include a plurality of drill pipes that have a tubular portion having a first outer diameter disposed between two ends having a tool joint having a second outer diameter that is larger than the first diameter. The system may further include a drill pipe protector disposed on the tubular portion of one of the plurality of drill pipes. The drill pipe protector of the system may have an outer diameter larger than the second diameter of the plurality of drill pipes and may be configured to protect the outer surface of each of the plurality of drill pipes.

In one or more embodiments, an apparatus may prevent rotational contact between a drill string and a casing and between the drill string and a wellbore to reduce torque and wear on the drill string and in the casing. The apparatus may include a first bearing assembly disposed on a tubular portion having a first outer diameter of a drill pipe of the drill string, and the first bearing assembly may include a plurality of sections coupled together such that the first bearing assembly clamps onto the tubular portion of the drill pipe. Further, the apparatus may include a second bearing assembly disposed adjacent to the first bearing assembly on the tubular portion of the drill pipe of the drill string, and the second bearing assembly may include a plurality of sections coupled together such that the second bearing assembly clamps onto the tubular portion of the drill pipe. Furthermore, the system may include a bearing sleeve disposed on the drill pipe of the drill string such that the bearing sleeve is maintained in an axial position relative to the drill pipe by the first bearing assembly and the second bearing assembly.

Other aspects and advantages of the disclosure will be apparent from the following description and the appended claims.

DETAILED DESCRIPTION

Figure 1A:
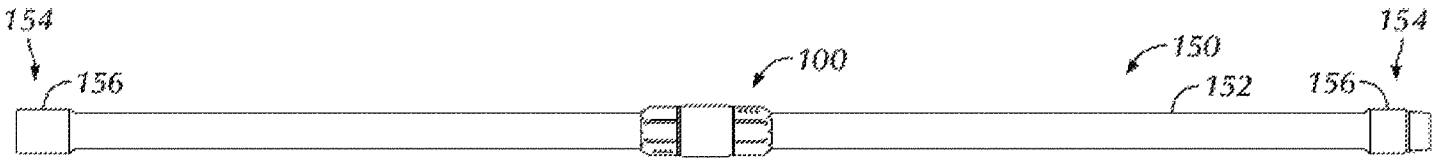
FIGS. 1A-1D illustrate multiple views of an apparatus for reducing torque on a drill string according to one or more embodiments of the present disclosure.

Embodiments of the present disclosure are described below in detail with reference to the accompanying figures. Like elements in the various figures may be denoted by like reference numerals for consistency. Further, in the following detailed description, numerous specific details are set forth in order to provide a more thorough understanding of the claimed subject matter. However, it will be apparent to one having ordinary skill in the art that the embodiments described may be practiced without these specific details. In other instances, well-known features have not been described in detail to avoid unnecessarily complicating the description.

Further, embodiments disclosed herein are described with terms designating orientation in reference to a horizontal wellbore, but any terms designating orientation should not be deemed to limit the scope of the disclosure. For example, embodiments of the disclosure may be made with reference to a vertical wellbore. It is to be further understood that the various embodiments described herein may be used in various orientations, such as inclined, inverted, horizontal, vertical, etc., and in other environments, such as sub-sea, without departing from the scope of the present disclosure. The embodiments are described merely as examples of useful applications, which are not limited to any specific details of the embodiments herein.

Referring to FIGS. 1A-1D, a drill pipe protector 100 for reducing torque on a drill string according to one or more embodiments of the present disclosure is shown. The drill pipe protector 100 may be disposed about a drill pipe 150 of the drill string. In one or more embodiments, the drill pipe 150 may include a tubular portion 152 having a first outer diameter disposed between ends 154, where the ends 154 may each include a tool joint 156 having a second outer diameter. The ends 154 may be configured to have a male thread on one end and a female thread on the other end such that multiple drill pipes 150 may be coupled together end-to-end in order to form the drill string. The second outer diameter of the tool joints 156 at the ends 154 of the drill pipe 150 may be substantially larger than the first outer diameter of the tubular portion 152 of the drill pipe 150 in order to accommodate the male and female threads for connecting adjacent drill pipes. Further, the outer diameter of a drill string may vary, for example along the tool joints and tubular portions of each drill pipe assembled to form the drill string, while an inner diameter of the drill string may remain relatively constant.

A drill pipe protector 100, according to one or more embodiments, may include a first bearing assembly 110, a second bearing assembly 120, and a bearing sleeve 130 coupled to the tubular portion 152 having a first outer diameter of the drill pipe 150. The first bearing assembly 110 and the second bearing assembly 120 may each include a first section 111, 121 and a second section 112, 122. The first section 111 and the second section 112 may be coupled together to form the first bearing assembly 110 and the first section 121 and the second section 122 may be coupled together to form the second bearing assembly 120, as shown in FIG. 1C by way of example only. The first section and a second sections of a bearing assembly may each have a swept angle of about 180°, such that when the sections are assembled together around the drill pipe 150, the bearing assembly extends 360° around the drill pipe. In one or more embodiments, each of the first sections 111, 121 and the second sections 112, 122, which are connected to form the first bearing assembly 110 and the second bearing assembly 120, respectively, may be substantially identical to each other such that any two sections of a bearing assembly may be coupled together in order to form two bearing assemblies of a drill pipe protector. Further, as shown in FIG. 1D by way of example only, the first bearing assembly 110 and the second bearing assembly 120 may each include a first portion 113, 123 and a second portion 114, 124. Additionally, an outer diameter of the first portion 113, 123 may be larger than the second outer diameter of the tool joints 156 at the ends 154 of the drill pipe 150, and the first portion 113, 123 may have a surface with a beveled edge 113A, 123A that is a distal edge from the second portion 114, 124.

Further, one of ordinary skill in the art will appreciate that each of the first bearing assembly 110 and the second bearing assembly 120 may include more than two sections and each section of the first bearing assembly 110 and the second bearing assembly 120 does not need to include a swept angle of about 180°. For example, a bearing assembly may include three sections, each section having a swept angle of about 120°, where the three sections may be assembled together around the tubular portion of a drill pipe to form the bearing assembly extending around the entire perimeter of the tubular portion.

Figure 1B:
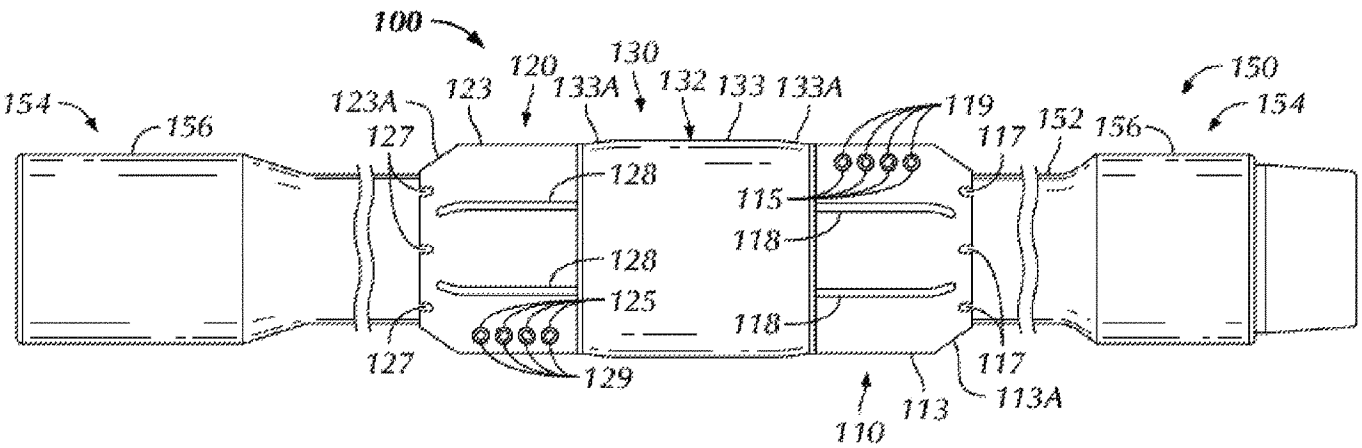
Figure 1C:
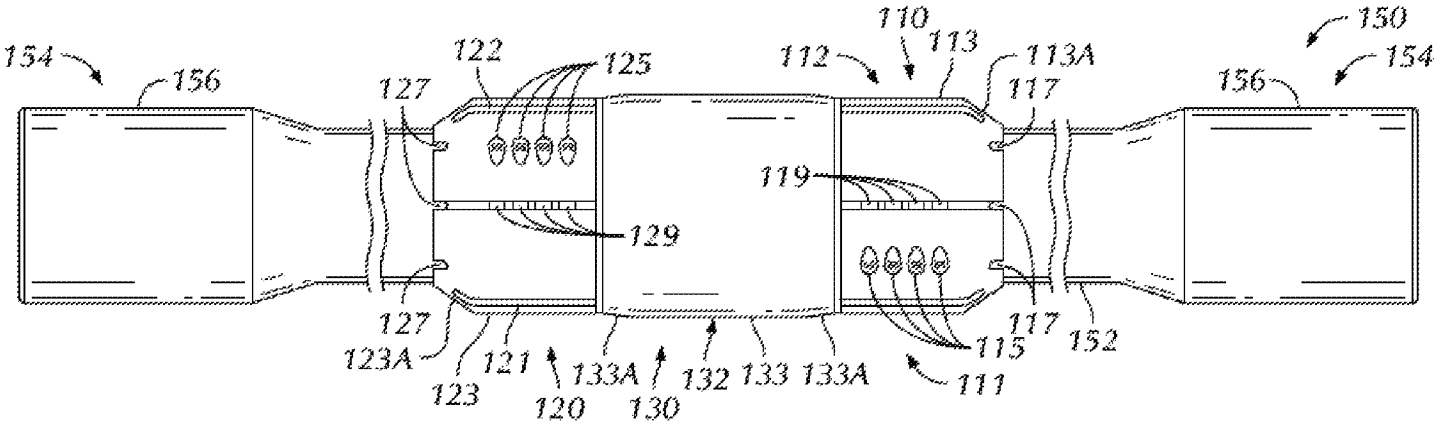
Figure 1D:
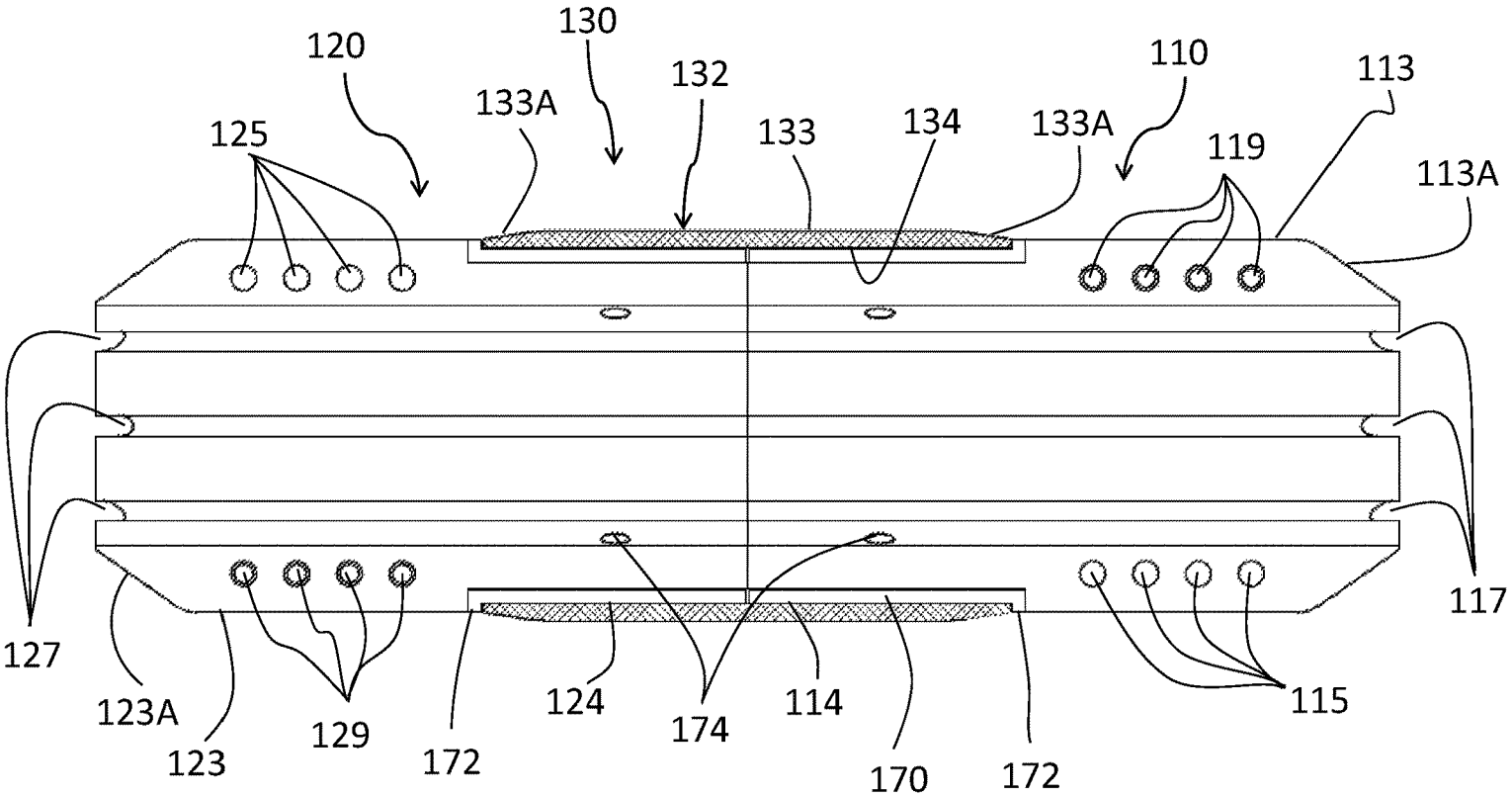

Referring to FIGS. 1B and 1C, in one or more embodiments, the large diameter portions 113, 123 may include a plurality of counterbore holes 115, 125 disposed adjacent to one end of the 180° swept angle of each of the first section 111, 121 and the second section 112, 122 and a plurality of threaded holes (not shown) disposed adjacent to the other end of the 180° swept angle of each of the first section 111, 121 and the second section 112, 122. The plurality of counterbore holes 115, 125 are disposed such that each of the plurality of counterbore holes 115, 125 aligns with a corresponding threaded hole and bolts 119, 129 may be inserted into the corresponding, aligned counterbore hole 115, 125 and threaded hole in order to couple the first section 111, 121 to the second section 112, 122 of each of the first bearing assembly 110 and the second bearing assembly 120. While one or more embodiments include a plurality of counterbore holes 115, 125, a plurality of threaded holes, and a plurality of bolts 119, 129, one of ordinary skill in the art will appreciate that any number of counterbore holes, threaded holes, and bolts may be used to couple the first section 111, 121 to the second section 112, 122 of each of the first bearing assembly 110 and the second bearing assembly 120. For example, in one or more embodiments, each of the first section 111, 121 and the second section 112, 122 may include a single counterbore hole 115, 125 and a single threaded hole that corresponds to the single counterbore hole 115, 125 of the other of the first section 111, 121 and the second section 112, 122.

Further, referring to FIG. 1D, the first bearing assembly 110 and the second bearing assembly 120 may be coupled to the tubular portion 152 (as shown in FIGS. 1A-1C) having a first outer diameter of the drill pipe 150 (as shown in FIGS. 1A-1C) such that the second portion 114 of the first bearing assembly 110 abuts the second portion 124 of the second bearing assembly 120. A clamping force may be applied to each of the first bearing assembly 110 and the second bearing assembly 120 in order to clamp each of the first bearing assembly 110 and the second bearing assembly 120 around the tubular portion 152 of the drill pipe 150 (as shown in FIGS. 1A-1C) such that each of the first bearing assembly 110 and the second bearing assembly 120 are held substantially in place relative to the drill pipe 150, where axial and rotational movement of each of the first bearing assembly 110 and the second bearing assembly 120 is minimized. As discussed above with reference to FIGS. 1B and 1C, the first section 111, 121 and the second section 112, 122 of each of the first bearing assembly 110 and the second bearing assembly 120 may be coupled to each other by way of corresponding, aligned counterbore holes 115, 125, threaded holes, and bolts 119, 129, and the bolts 119, 129 may be tightened sufficiently to create the clamping force that holds the bearing assemblies in place relative to the drill pipe 150.

Furthermore, referring to FIG. 1D, in one or more embodiments, the first bearing assembly 110 and second bearing assembly 120 may each include a bearing insert 170 that may be disposed on and cover each second portion 114, 124 of each section, 111, 112, 121, 122, respectively. Further, the bearing inserts 170 may each comprise a swept angle of about 180°. Additionally, the bearing inserts 170 may be assembled to the second portions 114, 124 by way of screws (not shown). The first bearing assembly 110 and the second bearing assembly 120 may include assembly holes 174 through respective second portions 114, 124. In one or more embodiments, the assembly holes 174 through the respective second portions 114, 124 may be threaded. Further, the bearing inserts 170 may include assembly holes (not shown) that are aligned with the assembly holes of the second portions 114, 124. Furthermore, the screws may be screwed through the threaded assembly holes 174 of the second portions 114, 124 such that the screws extend into the respectively aligned assembly holes of the bearing inserts 170 and such that the bearing inserts 170 are fixed to the second portions 114, 124. Additionally, each bearing insert 170 may include a shoulder 172 disposed on an end of the bearing insert 170 that is adjacent to the first portions 113, 123. In one or more embodiments, an outer diameter of the shoulder 172 may be smaller than or equal to an outer diameter of the first portions 113, 123 of the first bearing assembly 110 and the second bearing assembly 120, respectively. Further, in one or more embodiments, the bearing inserts 170 may be made of brass, bronze, ceramic, or any other low-friction material known in the art.

While screws may be used in one or more embodiments to affix the bearing inserts to the first bearing assembly and the second bearing assembly, in other embodiments, the bearing inserts may be assembled to the second portions by way of pins (not shown). In one or more embodiments, the pins may be disposed through aligned assembly holes of the second portions and the bearing inserts such that the bearing inserts are fixed to the second portions. In one or more embodiments, the assembly holes of the second portions and the assembly holes of the bearing inserts may have an inner diameter smaller than an outer diameter of the pins such that there is an interference fit between the pins and the assembly holes. Further, in one or more embodiments, a spline (not shown) or key seat (not shown) may be disposed between the bearing inserts and the second portions of the first and second bearing assemblies, which may prevent the bearing insert from rotation with respect to the second portions of the first and second bearing assemblies.

Additionally, referring to FIGS. 1B-1D, in one or more embodiments, each of the first bearing assembly 110 and the second bearing assembly 120 may include a plurality of inner diameter grooves 117, 127 and a plurality of outer diameter grooves 118, 128. Inner diameter grooves and/or outer diameter grooves may extend an entire or a partial length along the first and second bearing assemblies. As shown in FIG. 1D, by way of example only, the plurality of inner diameter grooves 117, 127 may extend axially along an entirety of an interior surface of each of the first bearing assembly 110 and the second bearing assembly 120. Further, as shown in FIG. 1B by way of example only, the plurality of outer diameter grooves 118, 128 may extend axially along an entirety of an outer surface of the first portion 113, 123 of each of the first bearing assembly 110 and the second bearing assembly 120. While one or more embodiments include a plurality of inner diameter grooves 117, 127 and a plurality of outer diameter grooves 118, 128, in one or more embodiments, any number of inner diameter grooves and outer diameter grooves may be included. In one or more embodiments, inner diameter grooves and outer diameter grooves may be formed in order to add flexibility to the bearing assemblies such that the bearing assemblies may better grip the drill pipe. The inner diameter grooves and outer diameter grooves may also be formed to allow as much flow as possible to pass through the drill pipe protector such that the drill pipe protector does not adversely affect the equivalent circulating density ("ECD") in the area of a wellbore in which the drill pipe protector is disposed. The ECD is the effective density that combines current mud density and annular pressure drop. The ECD is critical for drilling operations, because it can cause losses due to high pressure loss in the annulus. Further, the ECD is very critical in both well control and losses aspects in the areas where room between pore pressure and fracture gradient is narrow.

Still referring to FIGS. 1C and 1D, in one or more embodiments, the bearing sleeve 130 may include an outer sleeve 132. The outer sleeve 132 may be disposed axially between the first portion 113 of the first bearing assembly 110 and the first portion 123 of the second bearing assembly 120 and radially above each of the second portion 114 of the first bearing assembly 110 and the second portion 124 of the second bearing assembly 120. Further, in one or more embodiments, the outer sleeve 132 may be disposed radially outward from and adjacent to the bearing insert 170 of each of the first bearing assembly 110 and the second bearing assembly 120 and axially and directly between the shoulder 172 of each of the bearing insert 170 of the first bearing assembly 110 and the bearing insert 170 of the second bearing assembly 120. Therefore, in one or more embodiments, the outer sleeve 132 may be maintained in an axial position relative to the drill pipe 150 by the first bearing assembly 110 and the second bearing assembly 120, but may be able to rotate relative to the bearing insert 170 of each of the first bearing assembly 110 and the second bearing assembly 120.

Additionally, in one or more embodiments, the outer sleeve 132 of the bearing sleeve 130 may have an inner diameter 134 smaller than an outer diameter of the shoulder 172 of the bearing insert 170 of each of the first bearing assembly 110 and the second bearing assembly 120 such that the outer sleeve 132 may be maintained in an axial position relative to the drill pipe 150. Further, an inner diameter 134 of the outer sleeve 132 of the bearing sleeve 130 may be loose fitting on an outer diameter of each bearing insert 170 such that the outer sleeve 132 may rotate relatively freely against the bearing insert 170 of each of the first bearing assembly 110 and the second bearing assembly 120. In other words, the inner diameter 134 of the outer sleeve 132 may be constant and larger than an outer diameter of the bearing inserts 170 of the first bearing assembly 110 and the second bearing assembly 120. Additionally, the inner diameter 134 of the outer sleeve 132 may be larger than the second diameter of the tool joint 156 of the ends 154 of the drill pipe 150. By providing an outer sleeve with an inner diameter larger than the diameter of the tool joints of the drill string on which the drill pipe protector is assembled to, the outer sleeve may be a solid or single piece (having a swept angle of 360°) that may be slid over one of the tool joints and positioned around the small diameter portion of a first bearing assembly, where a second bearing assembly may then be assembled adjacent the first bearing assembly and outer sleeve to form the drill pipe protector. Further, in one or more embodiments, the outer sleeve 132 may include an outer surface 133 that has a constant outer diameter that is larger than the second diameter of the tool joint 156 at the ends 154 of the drill pipe 150, and the outer surface 133 may include bevels 133A on both edges of the outer surface 133.

Further, in one or more embodiments, an inner surface of the outer sleeve 132 may be manufactured from a low friction material. The low friction material on the inner surface of the outer sleeve 132 may allow for reduction in a torque produced on the drill pipe 150 and wear on the wellbore when the outer sleeve 132 contacts and rotates against the wellbore. Additionally, in one or more embodiments, an interior surface of each of the first bearing assembly 110 and the second bearing assembly 120 may be hard coated and/or prepared in such a way as to induce a maximum friction between an outer surface of the drill pipe 150 and the interior surface of each of the first bearing assembly 110 and the second bearing assembly 120 in order to minimize axial and rotational movement of each of the first bearing assembly 110 and the second bearing assembly 120 with relation to the drill pipe 150, e.g., by adding knurling to the bearing assembly interior surfaces. Furthermore, in one or more embodiments, an outer surface of the outer sleeve 132 may be one of hard coated or manufactured from a hard material. The hard coated or hard material outer surface of the outer sleeve 132 may allow for the outer surface of the outer sleeve 132 to minimize rotation of the bearing sleeve 130 against the wellbore when the bearing sleeve contacts the wellbore.

Additionally, as discussed above, in one or more embodiments, the bearing insert 170 may be manufactured from a low friction material. The low friction materials that the bearing insert may be manufactured from include brass, bronze, ceramic, and any other low friction material known in the art. The low friction material of the bearing insert 170 may allow for less torque being imposed on the drill pipe 150 when the outer sleeve 132 contacts the wellbore and rotates relative to the drill pipe 150. The low friction material of the bearing insert 170 contacting the inner surface of the outer sleeve 132 will help to reduce wear between the parts that rotate relative to each other in order to extend a life of the parts as well as to minimize the torque imposed on the drill pipe 150 by the rotation of the drill pipe protector 100 against the wellbore.

Figure 7:
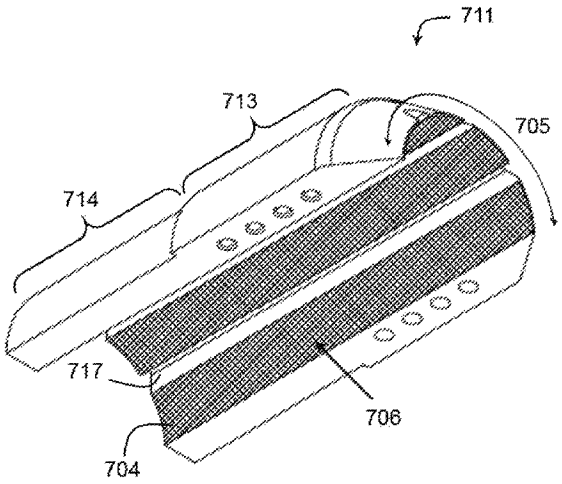
FIG. 7 illustrates a view of a section of a bearing assembly according to one or more embodiments of the present disclosure.

Additionally, in one or more embodiments, a knurling or frictional coating may be added to the interior surfaces of a first bearing assembly and/or a second bearing assembly that may further secure the bearing assemblies to a tubular portion of a drill pipe. For example, as shown in FIG. 7, a section 711 of a bearing assembly may include a first portion 713 and a second portion 714. Section 711 may extend circumferentially a swept angle 705 of about 180°, such that when assembled to a second section having a swept angle of about 180° to form the bearing assembly disposed around a tubular portion of a drill pipe, the bearing assembly may extend circumferentially around an entire circumference of the tubular portion. Section 711 may further have a plurality of inner diameter grooves 717 formed along a length of the section interior surface 704. When sections of a bearing assembly are assembled together to form the bearing assembly, the bearing assembly may have a central longitudinal axis extending through the central bore of the bearing assembly, where the interior surface 704 of the bearing assembly may have a substantially constant radius from the central longitudinal axis in some embodiments. The interior surface 704 may define an inner diameter of the assembled bearing assembly. In the embodiment shown, knurling 706 (a pattern of raised and depressed geometries (e.g., a pattern of straight, angled or crossed lines) to provide a surface roughness) is added to the interior surface 704. The entire or partial portions of an interior surface designed to contact an outer surface of a drill pipe may have knurling or a coating of high friction material (e.g., semi-metallic or ceramic frictional coating) applied thereto to increase the amount of frictional force between the interior surface of the bearing assembly and the outer surface of the drill pipe. One of ordinary skill in the art can appreciate that the extra friction may provide the rotation of the bearing assemblies to be in unison with the drill string to which the drill pipe protector for reducing torque is attached.

Figure 2A:
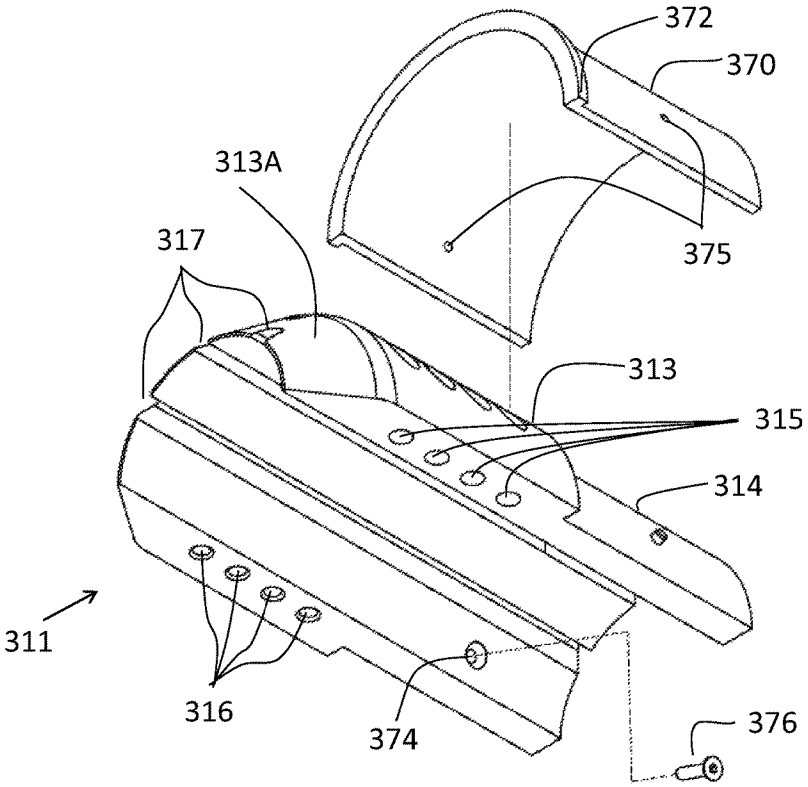
FIGS. 2A-2C illustrate multiple views of a bearing assembly according to one or more embodiments of the present disclosure.
Figure 2B:
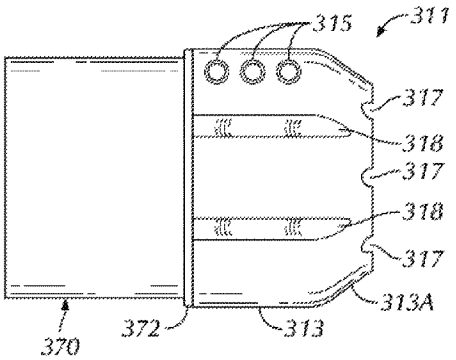
Figure 2C:
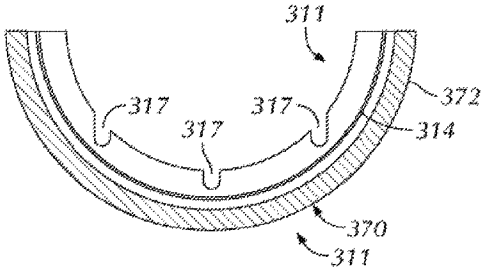

Referring now to FIGS. 2A-2C, a first section 311 of a first bearing assembly (not shown) according to one or more embodiments of the present disclosure is shown. As discussed above with reference to FIGS. 1A-1D, in one or more embodiments, both the first sections 111, 121 and the second sections 112, 122, which are connected to form the first bearing assembly 110 and the second bearing assembly 120, respectively, may be substantially identical to each other such that any two sections of a bearing assembly may be coupled together in order to form two bearing assemblies of a drill pipe protector. The first section 311 may have a swept angle of 180° and may include a first portion 313 and a second portion 314. An outer diameter of the first portion 313 may be larger than an outer diameter of the second portion 314, and an outer surface of the first portion 313 may include a beveled edge 313A that is distal to the second portion 314. The beveled edge 313A is configured to taper the outer surface of the first portion 313 such that an edge of an end of the first portion 313 is minimized in order to prevent a drill pipe protector (not shown) from catching or snagging against a portion of the wellbore. In other words, the beveled edge 313A may extend from the outer surface of the first portion 313 to a diameter substantially close to an outer surface of a drill pipe (not shown) in an area of the drill pipe in which the first bearing assembly is disposed. In one or more embodiments, the outer diameter of the first portion 313 may also be larger than a diameter of an end 154 of a drill pipe 150 that is larger than the outer diameter of the tubular portion 152 in the area of the drill pipe 150 in which the first bearing assembly is disposed.

Further, according to one or more embodiments, the first section 311 may further include a plurality of counterbore holes 315 and a plurality of threaded holes 316. The plurality of counterbore holes 315 may be disposed adjacent to one end of the 180° swept angle of the first section 311, and the plurality of threaded holes 316 may be disposed adjacent to the other end of the 180° swept angle of the first section 311. The plurality of counterbore holes 315 may be disposed such that they correspond to and align with corresponding threaded holes of a second section (not shown) of the first bearing assembly (not shown), and the plurality of threaded holes 316 may be disposed such that they correspond to and align with corresponding counterbore holes (not shown) of the second section of the first bearing assembly. As discussed above, in one or more embodiments, bolts (not shown) may be inserted into corresponding counterbore holes and threaded holes in order to couple the first section 311 and the second section to form the first bearing assembly.

Furthermore, the first section 311 may include a bearing insert 370 that may be disposed on and cover the second portion 314 of the first section 311. Further, the bearing insert 370 may comprise a swept angle of about 180°. Additionally, the bearing insert 370 may be assembled to the second portion 314 by way of screws 376. The first section 311 may include assembly holes 374 through the second portion 314. In one or more embodiments, the assembly holes 374 through the second portion 314 may be threaded. Further, the bearing insert 370 may include assembly holes 375 that are aligned with the assembly holes 374 of the second portion 314. Furthermore, the screws 376 may be screwed through the threaded assembly holes 374 of the second portion 314 such that the screws extend into the respectively aligned assembly holes 375 of the bearing insert 370 and such that the bearing insert 370 is fixed to the second portion 314. Additionally, the bearing insert 370 may include a shoulder 372 disposed on an end of the bearing insert 370 that is adjacent to the first portion 313 of the first section 311. Further, in one or more embodiments, an outer diameter of the shoulder 372 may be smaller than or equal to an outer diameter of the first portion 313 of the first section 311.

Still referring to FIGS. 2A-2C, in one or more embodiments, a plurality of inner diameter grooves 317 and a plurality of outer diameter grooves 318 may be formed on the first section 311 of the first bearing assembly. The plurality of inner diameter grooves 317 may extend axially along an entirety of an interior surface of the first section 311 of the first bearing assembly. Further, the plurality of outer diameter grooves 318 may extend axially along an entirety of an outer surface of the large diameter portion 313 of the first bearing assembly. As discussed above, the inner diameter grooves 317 and the outer diameter grooves 318 may be formed to allow as much flow of drilling fluids as possible to pass through the drill pipe protector such that the drill pipe protector does not adversely affect the ECD in the area of a wellbore in which the drill pipe protector is disposed.

Figure 3A:
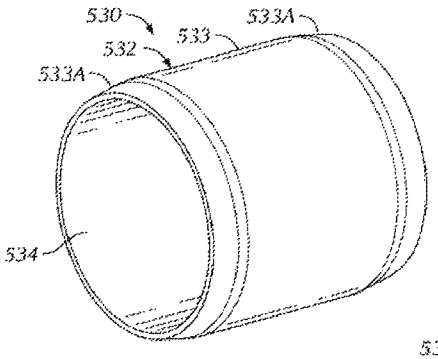
FIGS. 3A-3C illustrate multiple views of a bearing sleeve according to one or more embodiments of the present disclosure.
Figure 3B:
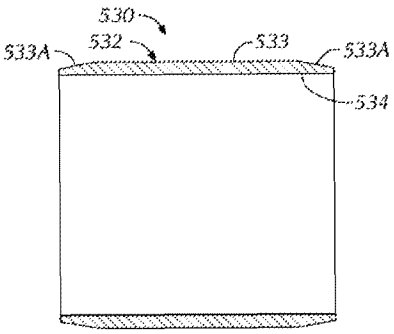
Figure 3C:
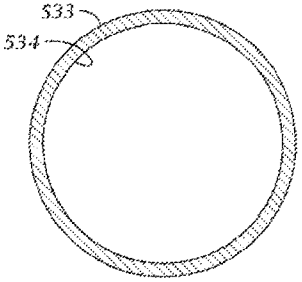

Referring now to FIGS. 3A-3C, an outer sleeve 532 of a bearing sleeve 530 according to one or more embodiments of the present disclosure is shown. The outer sleeve 532 may include an outer surface 533 that has a constant diameter that is larger than a diameter of ends of a drill pipe (not shown) and the outer surface 533 may include bevels 533A on both edges of the outer surface 533. The bevels 533A may be configured to taper the outer surface 533 of the outer sleeve 532 such that each edge of the outer surface 533 is minimized in order to prevent the outer sleeve 532 of a drill pipe protector (not shown) from catching or snagging against a portion of the wellbore. In other words, the bevels 533A of the outer sleeve 532 may extend from the outer surface 533 of the outer sleeve 532 to a diameter smaller than a diameter of a first portion (not shown) of a bearing assembly (not shown). Further, the outer sleeve 532 may include an inner surface profile 534 that has a constant diameter. The inner surface profile 534 of the outer sleeve 532 may bear against bearing inserts (not shown) of bearing assemblies (not shown) of the drill pipe protector on which the outer sleeve 532 may be assembled.

Figure 4D:
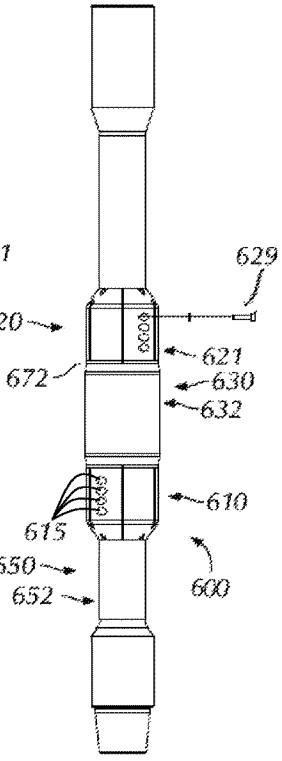
FIGS. 4A-4D illustrate a method of installing an apparatus for reducing torque on a drill string according to one or more embodiments of the present disclosure.
Figure 4C:
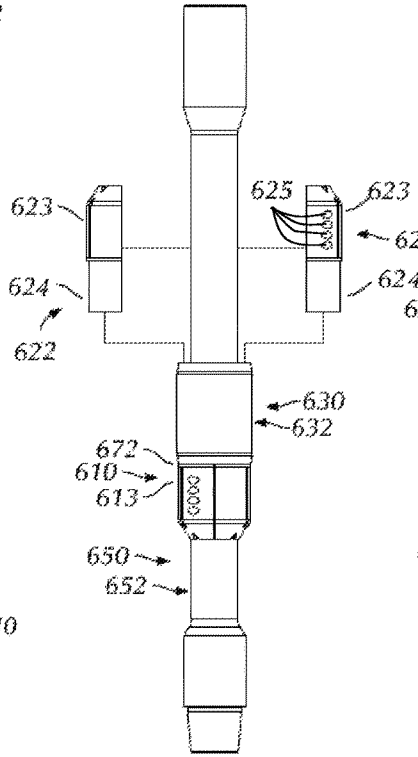

Referring now to FIGS. 4A-4D, an example of a method of installing a drill pipe protector 600 onto a drill pipe 650 of a drill string according to one or more embodiments of the present disclosure is described. In one or more embodiments, assembling the drill pipe protector 600 onto the drill pipe 650 may include orientating the drill pipe 650 vertically and shifting a solid outer sleeve 632 (being a single piece) of a bearing sleeve 630 over a tool joint 656 having a second diameter at an end 654 of the drill pipe 650 and axially along a length of the drill pipe 650 until the bearing sleeve 630 is above a final setup position of the drill pipe protector 600, as shown in FIG. 4C, by way of example only. The bearing sleeve 630 may then be temporarily held relative to the drill pipe 650 by using a set of installation clamps (not shown). The installation clamps may be made of a single flexible piece that wraps around a drill pipe 650 and latches such that the installation clamps are fixed axially relative to the drill pipe 650 and such that the installation clamps may bear the weight of the bearing sleeve 630 and hold the bearing sleeve 630 in place relative to the drill pipe 650.

Once the bearing sleeve 630 is disposed around and held relative to the drill pipe 650, a first bearing assembly 610 may be assembled and disposed around and attached to a tubular portion 652 having a first outer diameter of the drill pipe 650 such that a second portion 614 of the first bearing assembly 610 is disposed above a first portion 613 of the first bearing assembly 610. Assembly of the first bearing assembly 610 may include coupling a bearing insert 670 to a second portion 614 of both a first section 611 and a second section 612 of the first bearing assembly 610. To couple a bearing insert 670 to the second portions 614, the bearing insert 670 may be disposed on the second portion 614 of each of the first section 611 and second section 612 such that assembly holes (not shown) of the bearing insert 670 are aligned with assembly holes (not shown) of the second portion 614. Further, the assembly holes of the second portion 614 may be threaded such that screws (not shown) may be threaded from an inside of the bearing insert 670 through the assembly holes of the second portion 614 and extend into the assembly holes of the bearing insert 670. Once the screws have been inserted into the bearing insert 670 through the second portion 614 of the first bearing assembly 610, the bearing insert 670 may be fixed to the first bearing assembly 610.

Figure 4B:
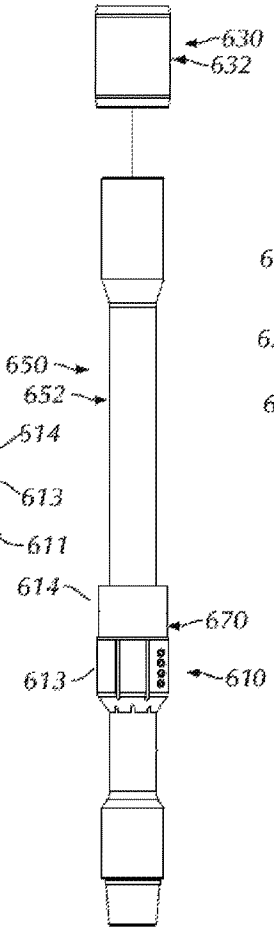
Figure 4A:
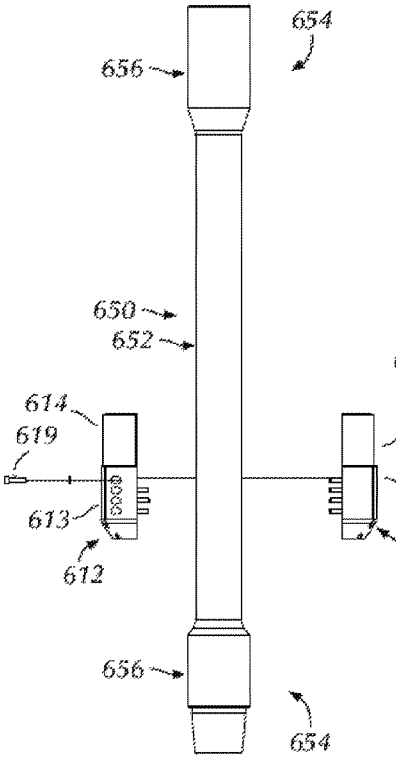

Further, as shown in FIGS. 4A and 4B, by way of example only, attaching the first bearing assembly 610 to the tubular portion 652 having a first outer diameter of the drill pipe 650 may include disposing a first section 611 of a first bearing assembly 610 against a tubular portion 652 of the drill pipe 650 such that a second portion 614 of the first bearing assembly 610 is disposed above a first portion 613 of the first bearing assembly 610. Further, a second section 612 of the first bearing assembly 610 may be disposed against the tubular portion 652 of the drill pipe 650 such that the second portion 614 of the first bearing assembly 610 is disposed above the first portion 613 of the first bearing assembly 610. The first section 611 and the second section 612 of the first bearing assembly 610 may then be shifted such that a plurality of counterbore holes 615 (FIG. 4D) of the first section 611 align with a plurality of threaded holes (not shown) of the second section and such that a plurality of counterbore holes (not shown) of the second section align with a plurality of threaded holes (not shown) of the first section 611. Once the pluralities of counterbore holes and the pluralities of threaded holes are aligned, bolts 619 may be inserted through the pluralities of counterbore holes and threaded into the pluralities of threaded holes. The bolts 619 may be tightened until the first bearing assembly 610 sufficiently clamps onto the tubular portion 652 of the drill pipe 650 such that the first bearing assembly 610 is held substantially in place relative to the drill pipe 650 and axial and rotational movement of the first bearing assembly 610 is minimized.

As shown in FIG. 4D, by way of example only, once the first bearing assembly 610 is clamped onto the tubular portion 652 having a first outer diameter of the drill pipe 650, the outer sleeve 632 of the bearing sleeve 630 may be coupled to the first bearing assembly 610. Coupling the outer sleeve 632 to the first bearing assembly 610 may include removing the installation clamps (not shown) and sliding the outer sleeve 632 down and over the bearing inserts 670 surrounding the second portion 614 of the first bearing assembly 610 until the outer sleeve 632 abuts a shoulder 672 of the bearing inserts 670 that is adjacent to the first portion 613 of the first bearing assembly 610. Further, when the outer sleeve 632 of the bearing sleeve 630 is assembled onto the first bearing assembly 610, the bearing sleeve 630 may rotate freely about the bearing inserts 670 of the first bearing assembly 610.

In the embodiment shown, the outer sleeve 632 may be slid over one end 654 of a drill pipe 650 and held in place at an axial position along the drill pipe while a first bearing assembly 610 is installed. However, in some embodiments, a first bearing assembly 610 may be installed and clamped around the tubular portion of a drill pipe prior to sliding an outer sleeve over an end of the drill pipe facing the second portion 614 of the assembled first bearing assembly 610.

Referring now to FIG. 4D, by way of example only, assembly of the drill pipe protector 600 may further include assembling a second bearing assembly 620, and then disposing the second bearing assembly 620 around the drill pipe 650 and attaching the second bearing assembly 620 to the tubular portion 652 having a first outer diameter of the drill pipe 650. Assembly of the second bearing assembly 620 may include coupling a bearing insert 670 to a second portion 624 of both a first section 621 and a second section (not shown) of the second bearing assembly 620. To couple a bearing insert 670 to the second portions 624, the bearing insert 670 may be disposed on the second portion 624 of each of the first section 621 and second section such that assembly holes (not shown) of the bearing insert 670 are aligned with assembly holes (not shown) of the small diameter portion 624. Further, the assembly holes of the small diameter portion 624 may be threaded such that screws (not shown) may be threaded from an inside of the bearing insert 670 through the assembly holes of the second portion 624 and extend into the assembly holes of the bearing insert 670. Once the screws have been inserted into the bearing insert 670 through the second portion 624 of the second bearing assembly 620, the bearing insert 670 may be fixed to the second bearing assembly 620.

Additionally, once the bearing inserts 670 are attached to each of the first section 621 and second section of the second bearing assembly 620, the first section 621 of the second bearing assembly 620 may be disposed against the tubular portion 652, having a first outer diameter of the drill pipe 650 such that a second portion 624 of first section 621 of the second bearing assembly 620 is disposed below a first portion 623 of the first section 621. Further, a second section 622 of the second bearing assembly 620 may be disposed against the tubular portion 652 of the drill pipe 650 such that the second portion 624 of the second section of the second bearing assembly 620 is disposed below the first portion 623 of the second section 622. The first section 621 and second section 622 may be slid downwards along the tubular portion 652 of the drill pipe 650 until the bearing inserts 670 of the second bearing assembly 620 slide into a gap formed between the outer sleeve 632 and the tubular portion 652 and an end of the second portion 624 of the second bearing assembly 620 abuts an end of the second portion 614 of the first bearing assembly 610, as shown in FIG. 4C, by way of example only.

Once the end of the second portion 624 of each of the first section 621 and second section 622 of the second bearing assembly 620 abut the end of the second portion 614 of the first bearing assembly 610, slight adjustments to positions of the first section 621 and the second section of the second bearing assembly 620 may be made in order to align a plurality of counterbore holes 625 of the first section 621 with a plurality of threaded holes (not shown) of the second section and such that a plurality of counterbore holes (not shown) of the second section align with a plurality of threaded holes (not shown) of the first section 621. Once the pluralities of counterbore holes and the pluralities of threaded holes are aligned, bolts 629 may be inserted through the pluralities of counterbore holes and threaded into the pluralities of threaded holes. The bolts 629 may be tightened until the second bearing assembly 620 sufficiently clamps onto the tubular portion 652 of the drill pipe 650 such that the second bearing assembly 620 is held substantially in place relative to the drill pipe 650 and axial and rotational movement of the second bearing assembly 620 is minimized.

Referring now to FIGS. 5A-5E, a drill pipe protector 1200 for reducing torque on a drill string according to one or more embodiments of the present disclosure is shown. The drill pipe protector 1200 may be disposed about a drill pipe 1250 of the drill string. In one or more embodiments, the drill pipe 1250 may include a tubular portion 1252 having a first outer diameter disposed between ends 1254 that have a tool joint 1256 having a second outer diameter. As discussed above, in one or more embodiments, the second outer diameter of the tool joint 1256 of the ends 1254 of the drill pipe 1250 may be substantially larger than the first outer diameter of the tubular portion 1252 of the drill pipe 1250.

A drill pipe protector 1200, according to one or more embodiments, may include a first bearing assembly 1210, a second bearing assembly 1220, and a bearing sleeve 1230 coupled to the tubular portion 1252 having a first outer diameter of the drill pipe 1250. The first bearing assembly 1210 and the second bearing assembly 1220 may each include a first section 1211, 1221 and a second section 1212, 1222 that each comprise a swept angle of about 180° and that are coupled together to form the first bearing assembly 1210 and the second bearing assembly 1220, as shown in FIG. 5B-5D, by way of example only. In one or more embodiments, each of the first sections 1211, 1221 and the second sections 1212, 1222 may be substantially identical to each other such that any two sections of a bearing assembly may be coupled together in order to form two bearing assemblies of a drill pipe protector. Further, as shown in FIG. 5D by way of example only, the first bearing assembly 1210 and the second bearing assembly 1220 may each include a second portion 1213, 1223 and a second portion 1214, 1224. Additionally, an outer diameter of the large diameter portion 1213, 1223 may be larger than the second outer diameter of the tool joint 1256 of the ends 1254 of the drill pipe 1250, and the first portion 1213, 1223 may have a surface with a beveled edge 1213A, 1223A that is a distal edge from the second portion 1214, 1224.

Further, referring to FIGS. 5A-5E, in one or more embodiments, the first portions 1213, 1223 may include a plurality of counterbore holes 1215, 1225 disposed adjacent to one end of the 180° swept angle of each of the first section 1211, 1221 and the second section 1212, 1222 and a plurality of threaded holes 1216, 1226 disposed adjacent to the other end of the 180° swept angle of each of the first section 1211, 1221 and the second section 1212, 1222. The plurality of counterbore holes 1215, 1225 are disposed such that each of the plurality of counterbore holes 1215, 1225 aligns with a corresponding threaded hole 1216, 1226 and bolts 1219, 1229 may be inserted into the corresponding, aligned counterbore hole 1215, 1225 and threaded hole 1216, 1226 in order to couple the first section 1211, 1221 to the second section 1212, 1222 of each of the first bearing assembly 1210 and the second bearing assembly 1220.

Additionally, referring to FIGS. 5C and 5D, in one or more embodiments, each of the first sections 1211, 1221 and the second sections 1212, 1222 of the first bearing assembly 1210 and the second bearing assembly 1220 may include complimentary interlocking profiles 1280, 1281 that consist of shear tabs 1282 and shear recesses 1283. The first interlocking profile 1280 may be formed on one end of the 180° swept angle of each of the first section 1211, 1221 and the second section 1212, 1222 of the first bearing assembly 1210 and the second bearing assembly 1220. The first interlocking profile may include a plurality of shear tabs 1282 disposed along the end of the 180° swept angle in both the first portions 1213, 1223 and the second portions 1214, 1224. The second interlocking profile 1281 may be formed on the other end of the 180° swept angle of each of the first section 1211, 1221 and the second section 1212, 1222 of the first bearing assembly 1210 and the second bearing assembly 1220 from the first interlocking profile 1280. The second interlocking profile 1281 may include a plurality of shear recesses 1283 disposed along the end of the 180° swept angle in both the first portions 1213, 1223 and the second portions 1214, 1224 such that the shear recesses 1283 of the second interlocking profile 1281 align with the shear tabs 1282 of the first interlocking profile 1280. The complimentary interlocking profiles 1280, 1281 aid in relieving shear stresses experienced by the bolts 1219, 1229. By way of example only, the shear tabs 1282 and shear recesses 1283 of the interlocking profiles 1280, 1281 may relieve shear stresses on the bolts 1219, 1229 if an axial force is applied to only one of the first section 1211, 1221 or the second section 1212, 1222 of one of the first bearing assembly 1210 or the second bearing assembly 1220. Additionally, while interlocking profiles including exclusively a plurality of shear tabs or a plurality of shear recesses are shown, one of ordinary skill in the art would understand that in one or more embodiments, any combination of shear tabs and shear recesses may be used to form one interlocking profile and a complimentary combination of shear tabs and shear recesses may be used to form the complimentary interlocking profile. Further, while one or more embodiments include a plurality of shear tabs and shear recesses, one of ordinary skill in the art will appreciate that any number of complimentary shear tabs and shear recesses may be used to relieve shear stresses experienced by the bolts of a first and second bearing assembly.

Further, referring to FIG. 5D, the first bearing assembly 1210 and the second bearing assembly 1220 may be coupled to the tubular portion 1252 having a first outer diameter of the drill pipe 1250 such that the second portion 1214 of the first bearing assembly 1210 abuts the second portion 1224 of the second bearing assembly 1220. A clamping force may be applied to each of the first bearing assembly 1210 and the second bearing assembly 1220 in order to clamp each of the first bearing assembly 1210 and the second bearing assembly 1220 onto the first outer diameter of the tubular portion 1252 of the drill pipe 1250 such that each of the first bearing assembly 1210 and the second bearing assembly 1220 are held substantially in place relative to the drill pipe 1250 and axial and rotational movement of each of the first bearing assembly 1210 and the second bearing assembly 1220 is minimized. As discussed above, the first section 1211, 1221 and the second section 1212, 1222 of each of the first bearing assembly 1210 and the second bearing assembly 1220 may be coupled to each other by way of corresponding, aligned counterbore holes 1215, 1225, threaded holes 1216, 1226, and bolts 1219, 1229, and the bolts 1219, 1229 may be tightened sufficiently to create the clamping force necessary.

Furthermore, referring to FIG. 5C, in one or more embodiments, the first bearing assembly 1210 and second bearing assembly 1220 may each include a bearing insert 1270 that may be disposed on and cover each second portion 1214, 1224 of each section, 1211, 1212, 1221, 1222, respectively. Further, the bearing inserts 1270 may each comprise a swept angle of about 180°. Additionally, the bearing inserts 1270 may be assembled to the second portions 1214, 1224 by way of pins 1276 (shown in FIG. 5E). The first bearing assembly 1210 and the second bearing assembly 1220 may include assembly holes 1274 through respective second portions 1214, 1224. Further, the bearing inserts 170 may include assembly holes 1275 that are aligned with the assembly holes 1274 of the second portions 1214, 1224. A diameter of the assembly holes 1274 of the second portions 1214, 1224 and a diameter of the assembly holes 1275 of the bearing inserts 1270 may be smaller than a diameter of the pins 1276. Further, the pins 1276 may be forced into the aligned assembly holes 1274, 1275 of the second portions 1214, 1224 and the bearing inserts 1270 such that the bearing inserts 1270 are fixed to the second portions 1214, 1224 by way of an interference fit of the pins 1276. Further, while pins may be used to affix the bearing inserts to the first bearing assembly and the second bearing assembly, in other embodiments, as discussed above, the bearing inserts may be assembled to the small diameter portions by way of screws and threaded assembly holes.

Additionally, each bearing insert 1270 may include a shoulder 1272 disposed on an end of the bearing insert 1270 that is adjacent to the first portions 1213, 1223. In one or more embodiments, an outer diameter of the shoulder 1272 may be smaller than or equal to an outer diameter of the first portions 1213, 1223 of the first bearing assembly 1210 and the second bearing assembly 1220, respectively. Further, as discussed above, in one or more embodiments, the bearing inserts 1270 may be made of brass, bronze, ceramic, or any other low-friction material known in the art.

Figure 5A:
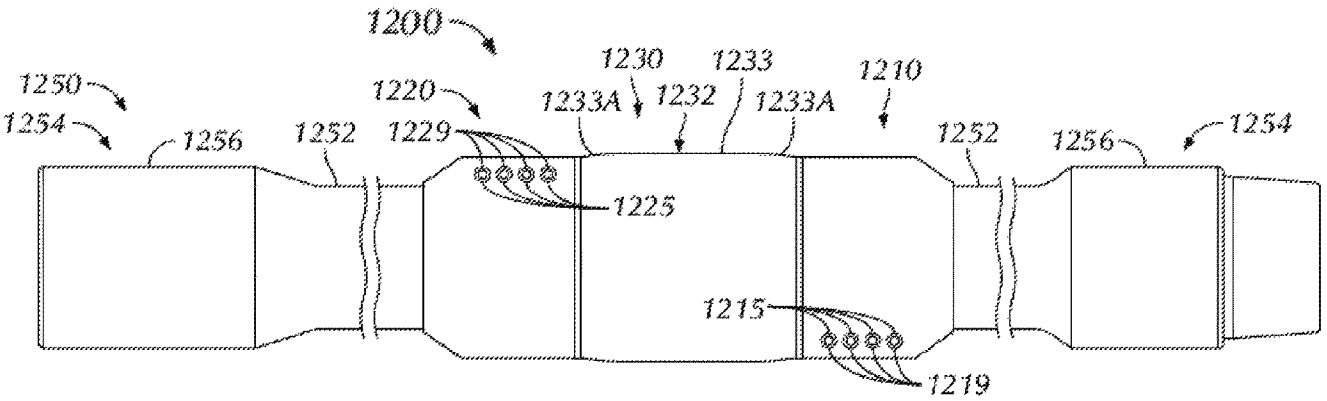
FIGS. 5A-5E illustrate multiple views of an apparatus for reducing torque on a drill string according to one or more embodiments of the present disclosure.
Figure 5B:
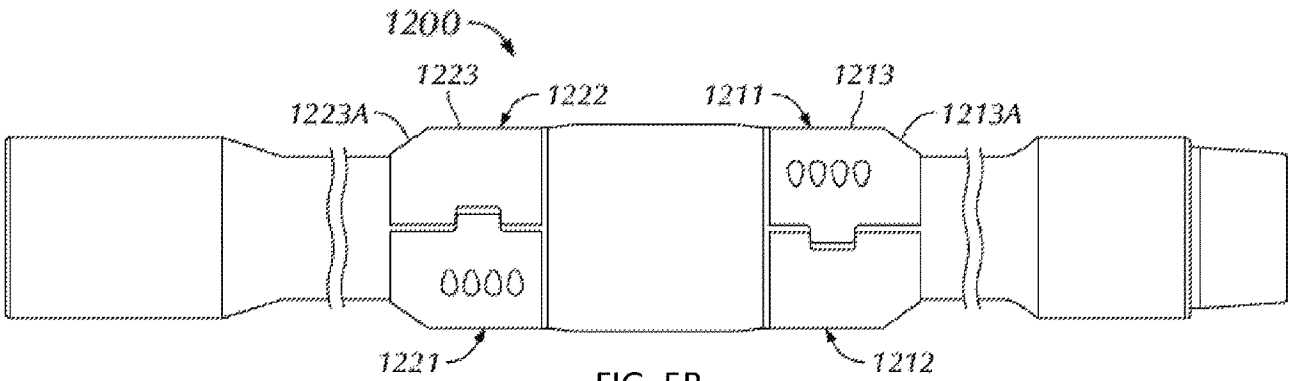
Figure 5C:
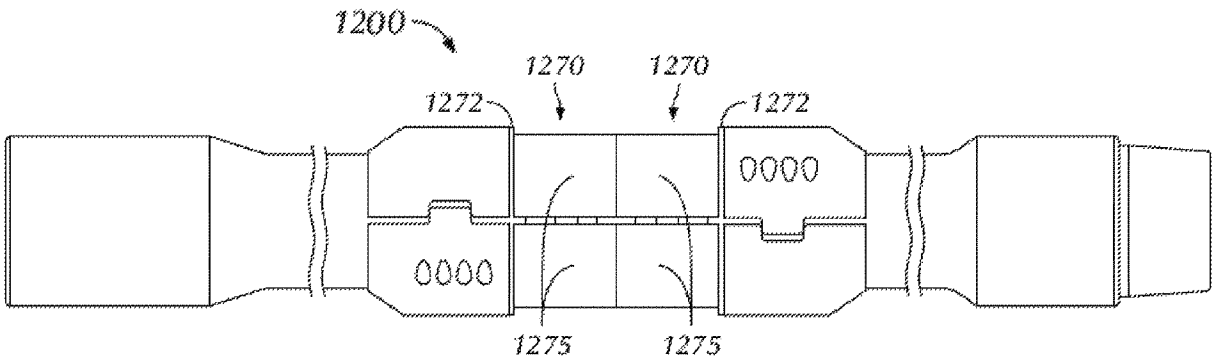
Figure 5D:
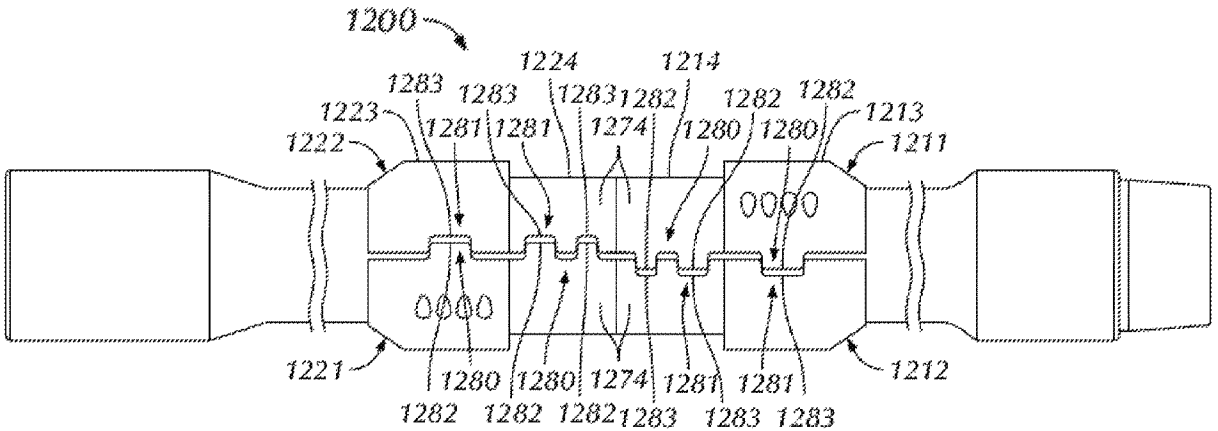
Figure 5E:
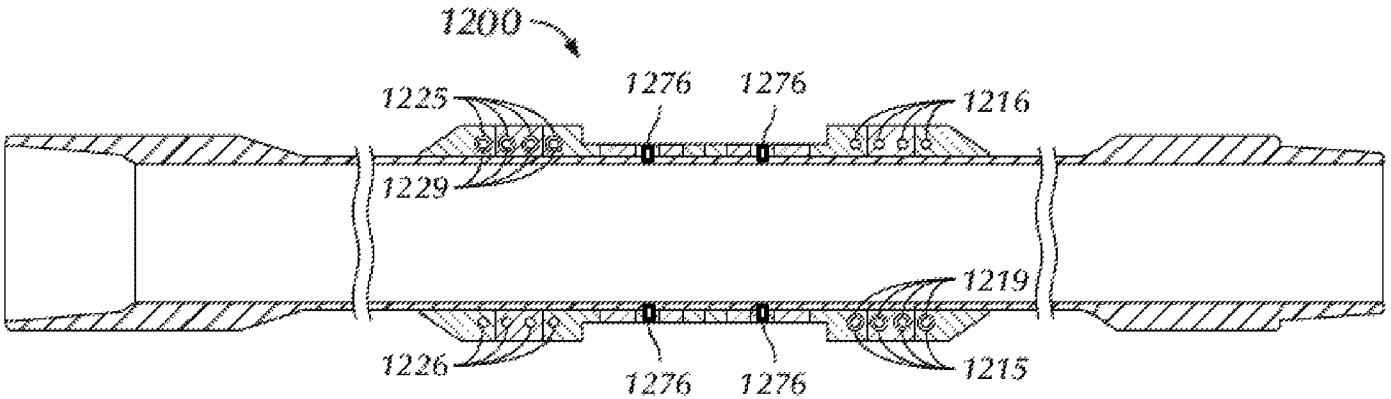

Referring to FIGS. 5A and 5B, in one or more embodiments, the bearing sleeve 1230 may include an outer sleeve 1232. The outer sleeve 1232 may be disposed axially between the first portion 1213 of the first bearing assembly 1210 and the first portion 1223 of the second bearing assembly 1220 and radially above each of the second portion 1214 of the first bearing assembly 1210 and the second portion 1224 of the second bearing assembly 1220. Further, in one or more embodiments, the outer sleeve 1232 may be disposed radially above and adjacent to the bearing insert 1270 of each of the first bearing assembly 1210 and the second bearing assembly 1220 and axially and directly between the shoulder 1272 of each of the bearing insert 1270 of the first bearing assembly 1210 and the bearing insert 1270 of the second bearing assembly 1220. Therefore, in one or more embodiments, the outer sleeve 1232 may be maintained in an axial position relative to the drill pipe 1250 by the first bearing assembly 1210 and the second bearing assembly 1220, but may be able to rotate relative to the bearing insert 1270 of each of the first bearing assembly 1210 and the second bearing assembly 1220.

Additionally, in one or more embodiments, the outer sleeve 1232 of the bearing sleeve 1230 may have an inner diameter (not shown) smaller than an outer diameter of the shoulder 1272 of the bearing insert 1270 of each of the first bearing assembly 1210 and the second bearing assembly 1220 such that the outer sleeve 1232 may be maintained in an axial position relative to the drill pipe 1250. Further, an inner surface 1234 of the outer sleeve 1232 of the bearing sleeve 1230 may be loose fitting on an outer diameter of each bearing insert 1270 such that the outer sleeve 1232 may rotate relatively freely against the bearing insert 1270 of each of the first bearing assembly 1210 and the second bearing assembly 1220. In other words, the inner surface 1234 of the outer sleeve 1232 may have a constant diameter that is larger than an outer diameter of the bearing inserts 1270 of the first bearing assembly 1210 and the second bearing assembly 1220. Additionally, the inner surface 1234 of the outer sleeve 1232 may be larger than the second diameter of the tool joint 1256 of the ends 1254 of the drill pipe 1250. Further, in one or more embodiments, the outer sleeve 1232 may include an outer surface 1233 that has a constant diameter that is larger than the second diameter of the tool joint 1256 of the ends 1254 of the drill pipe 1250 and the outer surface 1233 may include bevels 1233A on both edges of the outer surface 1233.

Further, similar to embodiments described above, in one or more embodiments, an inner surface of the outer sleeve 1232 may be manufactured from a low friction material. Additionally, in one or more embodiments, an interior surface of each of the first bearing assembly 1210 and the second bearing assembly 1220 may be hard coated and/or prepared in such a way as to induce a maximum friction. Furthermore, in one or more embodiments, an outer surface of the outer sleeve 1232 may be one of hard coated or manufactured from a hard material. Additionally, as discussed above, in one or more embodiments, the bearing insert 1270 may be made from a low friction material, such that an interface between the outer surface of the bearing insert and the inner surface of the outer sleeve have reduced friction therebetween. The low friction materials used may include brass, bronze, ceramic, and any other low friction material known in the art.

Figure 6:
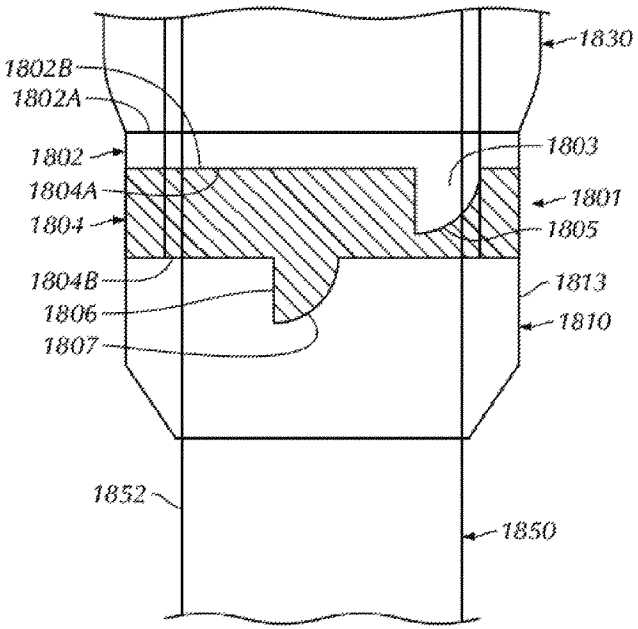
FIG. 6 illustrates a clutch assembly of an apparatus for reducing torque on a drill string according to one or more embodiments of the present disclosure.

Referring now to FIG. 6, in one or more embodiments, a clutch system 1801 of a drill pipe protector (not shown) according to one or more embodiments of the present disclosure is shown. In one or more embodiments, a drill pipe protector having the clutch system 1801 may include a first bearing assembly 1810, a second bearing assembly (not shown), and a bearing sleeve 1830 coupled to a tubular portion 1852 with a first outer diameter of a drill pipe 1850. According to one or more embodiments, the clutch system 1810 may be disposed axially between the first bearing assembly 1810 and the bearing sleeve 1830 or may be disposed axially between the second bearing assembly (not shown) and the bearing sleeve 1830.

Still referring to FIG. 6, in one or more embodiments, the clutch system 1801 may include a first ring 1802 and a second ring 1804. A first ring 1802 may be made of steel and a first side 1802A of the first ring 1802 may abut an end of the bearing sleeve 1830. Further, the first ring 1802 may include a tooth 1803 that extends from a second side 1802B of the first ring 1802 in a direction towards a first portion 1813 of the first bearing assembly 1810 and away from the bearing sleeve 1830. The second ring 1804 may be formed such that it is compressible, deformable, or breakable when subjected to a downward axial force, and the second ring 1804 may be disposed adjacent to the second side 1802B of the first ring 1802. Further, the second ring 1804 may include a groove 1805 formed on a first side 1804A of the second ring 1804 that corresponds to the tooth 1803 of the first ring 1802 such that the tooth 1803 may engage the groove 1805 when the drill pipe protector including the clutch system 1801 is assembled. The second ring 1804 may further include a tooth 1806 that extends from a second side 1804B of the second ring 1804 in a direction towards a first portion 1813 of the first bearing assembly 1810 and away from the bearing sleeve 1830. Further, in one or more embodiments, the groove 1805 and the tooth 1806 of the second ring 1804 may be circumferentially offset from each other. Furthermore, in one or more embodiments, the first portion 1813 of the first bearing assembly 1810 may include a groove 1807 formed on a side of the first portion 1813 adjacent to a second portion (not shown) that corresponds to the tooth 1806 of the second ring 1804 such that the tooth 1806 may engage the groove 1807 when the drill pipe protector including the clutch system 1801 is assembled.

In one or more embodiments, if a downward axial force is applied to a top of the bearing sleeve 1830, the second ring 1804 of the clutch system 1801 may be compressed and allow for the tooth 1803 of the first ring 1802 to engage into a corresponding, matching groove 1807 of the first portion 1813 of the first bearing assembly 1810. Engagement between the tooth 1803 of the first ring 1802 and the groove 1807 of the first portion 1813 of the first bearing assembly 1810 cause the bearing sleeve 1830 to no longer be able to rotate. Stopping the ability of the bearing sleeve 1830 to rotate with respect to the drill pipe 1850 may allow for a wash over operation of the bearing sleeve 1830 to be conducted. Further, while a single tooth is shown on both the first ring and the second ring as well as their corresponding grooves, one of ordinary skill in the art would understand that a series of teeth and grooves may be disposed circumferentially around the first ring and the second ring of the clutch system.

Figure 8C:
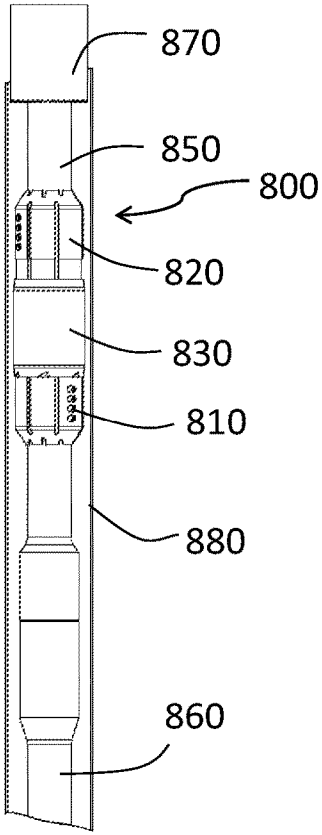
FIGS. 8A-8C illustrate a clutch system in a drill pipe protector by forming clutch mechanisms according to one or more embodiments of the present disclosure.
Figure 8B:
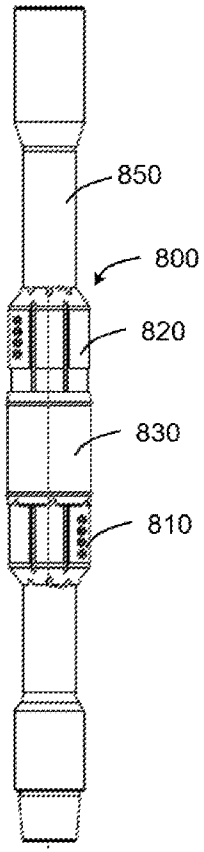
Figure 8A:
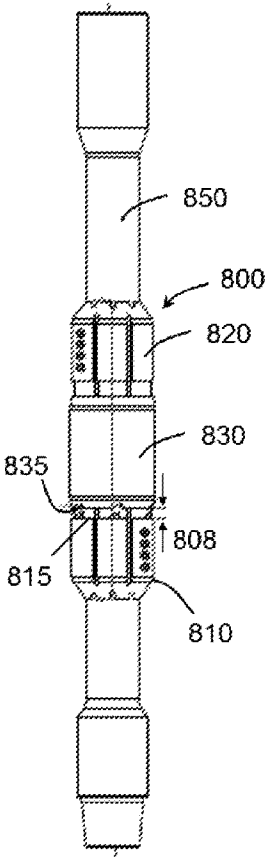

In some embodiments, a clutch system may be provided in a drill pipe protector 800 by forming clutch mechanisms (e.g., corresponding groove and tooth profiles or other interlocking profiles) along adjacent ends of an outer sleeve and a first portion of a bearing assembly. For example, referring to FIGS. 8A-8C, a drill pipe protector 800 is assembled around a tubular portion of a drill pipe 850, the drill pipe protector 800 including a first bearing assembly 810, a second bearing assembly 820 and a bearing sleeve 830 axially retained between first portions of the first and second bearing assemblies 810, 820. A bearing sleeve end 835 facing a first portion end 815 may have one or more grooves extending an axial depth into the bearing sleeve 830. The first portion end 815 may have one or more teeth having a shape corresponding to the groove(s) extending axially toward the bearing sleeve 830. In some embodiments, a bearing sleeve end may have one or more teeth and an adjacent first portion end may have one or more corresponding grooves. A gap 808 may be present between the bearing sleeve end 835 and the first portion end 815 while the drill pipe 850 (as part of an assembled drill string) is lowered into a wellbore 880 (shown in FIG. 8C), shown in FIG. 8A, such that the drill pipe 850 may rotate relative to the outer sleeve of the bearing sleeve 830 (e.g., the outer sleeve may remain stationary while the drill pipe rotates). When the drill pipe 850 is pulled out of the wellbore 880, shown in FIGS. 8B and 8C, the gap 808 may close and the clutch mechanisms engage, such that the outer sleeve of the bearing sleeve 830 and the drill pipe 850 may rotate in unison. Furthermore, an overshot mill sub 870 may be used when the drill pipe 850 is pulled out of the wellbore 880, shown in FIG. 8C, and the drill pipe 850 may have a second drill pipe 860 joined end-to-end.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An apparatus for reducing torque on a drill string, comprising:

a first bearing assembly and a second bearing assembly, each formed from a plurality of sections and adapted to be clamped around a tubular portion of a drill pipe;

wherein each of the bearing assembly sections comprises a first portion and a second portion, with a diameter of the second portion being smaller than a diameter of the first portion;

a plurality of grooves formed axially along an interior surface of each of the first and second bearing assemblies, wherein the plurality of grooves form an opening from an exterior surface of the drill pipe to the interior surface of each of the first and second bearing assemblies;

a plurality of bearing inserts fixed to the second portions of the sections of the first and second bearing assemblies, wherein each of the plurality of bearing inserts includes a shoulder disposed at an end of the bearing insert that spans a full length of the second portions of the first and second bearing assemblies, and wherein the bearing inserts are manufactured from a low friction material; and a bearing sleeve adapted to be disposed around the bearing inserts and retained in an axial position along the drill pipe by the shoulders on the bearing inserts, wherein an exterior surface of the bearing sleeve is hard coated or manufactured from a hard material.

2. The apparatus of claim 1, wherein:

the first portion of each of the first bearing assembly and the second bearing assembly has one beveled edge at an end of the first and second bearing assemblies that is distal to the second portion.

3. The apparatus of claim 1, wherein the bearing sleeve comprises:

a solid outer sleeve having at least one beveled edge on an outer surface of the solid outer sleeve.

4. The apparatus of claim 1, wherein each of the sections of the first bearing assembly and the second bearing assembly comprise:

a counterhore hole; and a threaded hole, wherein the counterbore hole of a first section of each of the first bearing assembly and the second bearing assembly alis with the threaded hole of an adjacent section of each of the first bearing assembly and the second bearing assembly when the first sections of the first bearing assembly and the second hearing assembly are coupled to the adjacent sections of the first bearing assembly and the second hearing assembly.

5. The apparatus of claim 4, further comprising:

a plurality of bolts disposed through aligned counterhore holes and threaded holes such that the sections of each of the first bearing assembly and the second bearing assembly are coupled together and clamped on the tubular portion of the drill pipe.

6. The apparatus claim 1, wherein each section of the plurality of sections of the first and second bearing assemblies comprise:

a first section; and a second section coupled to the first section;

each of the first section and the second section having a swept angle of about 180 degrees.

7. The apparatus of claim 1, wherein at least a portion of an interior surface of the first bearing assembly and the second bearing assembly comprise a knurled surface.

8. The apparatus of claim 1, further comprising a clutch system disposed axially between the bearing sleeve and the first portion of one of the first bearing assembly or the second bearing assembly and radially outward of the second portion of the one of the first bearing assembly or the second bearing assembly, wherein the clutch system further comprises:

a first ring formed at an axial end of the bearing sleeve;

a second ring disposed axially between the first ring and the first portion, wherein the second ring is configured to one of compress, deform, or break upon axial force being applied from the first ring to the second ring.

9. The apparatus of claim 8, wherein:

the first ring includes a tooth extending from a side of the first ring; and a groove formed in an adjacent end of the second ring, the tooth from the side of the first ring extends into the groove;

wherein the second ring has a second tooth circumferentially offset from the groove, the second tooth extending into a second groove formed in first portion.

10. The apparatus of claim 8, wherein:

the first ring is manufactured from steel.

11. The apparatus of claim 1, wherein each of the sections of each of the first bearing assembly and the second bearing assembly further comprise:

a coupling system that includes interlocking profiles formed at adjacent ends of the sections.

12. The apparatus of claim 11, wherein the interlocking profiles comprise a plurality of shear tabs and shear recesses.

13. A method comprising:

clamping a first bearing assembly on a tubular portion of a drill pipe, the tubular portion having a first outer diameter, the first bearing assembly comprising a plurality of bearing inserts fixed to the first bearing assembly, and each of the plurality of bearing inserts includes a shoulder disposed at an end of the bearing insert that spans a full length of the second portions of the first and second bearing assemblies;

sliding a bearing sleeve axially over an end of the drill pipe, the end of the drill pipe having a tool joint with a second outer diameter greater than the first outer diameter, until the bearing sleeve is disposed around the plurality of bearing inserts and contacts the shoulder of each bearing insert on the first bearing assembly;

clamping a second bearing assembly on the tubular portion of the drill pipe such that the bearing sleeve is disposed between first portions of the first bearing assembly and the second bearing assembly and maintained in a fixed axial position relative to the drill pipe; and forming an opening from an exterior surface of the drill pipe to an interior surface of each of the first and second bearing assemblies with a plurality of grooves axially along an interior surface of each of the first and second bearing assemblies.

14. The method of claim 13, wherein clamping the first bearing assembly and clamping the second bearing assembly each comprise:

disposing a first section on the tubular portion of the drill pipe;

disposing a second section on the tubular portion of the drill pipe; aligning counterbore holes and threaded holes on each of the first and second sections;

inserting bolts through the aligned counterbore holes and threaded holes; and tightening the belts.

15. The method of claim 13, wherein clamping the second bearing assembly comprises:

placing a plurality of sections of the second bearing assembly against the tubular portion of the drill pipe;

sliding the second bearing assembly axially along the drill pipe until a second portion of the second bearing assembly is disposed beneath the bearing sleeve and adjacent to a second portion of the first bearing assembly, the second portions having a diameter smaller than the first portions; and clamping the sections of the second bearing assembly together around the tubular portion of the drill pipe.

16. An apparatus for reducing torque on a drill string, comprising;

a first bearing assembly and a second bearing assembly, each formed from a plurality of sections and adapted to be clamped around a tubular portion of a drill pipe;

a bearing sleeve adapted to be retained in an axial position along the drill pipe by the first bearing assembly and the second bearing assembly; and a clutch system disposed axially between the bearing sleeve and the first portion of one of the first bearing assembly or the second bearing assembly and radially outward of the second portion of the one of the first bearing assembly or the second bearing assembly, wherein the clutch system comprises:

interlocking profiles formed between the bearing sleeve and the first portion of the first or second bearing assembly, such that when the interlocking profiles are engaged, the bearing sleeve rotates with the first portion, a first ring formed at an axial end of the bearing sleeve, a second ring disposed axially between the first ring and the first portion, and wherein the second ring is configured to one of compress, deform, or break upon axial force being applied from the first ring to the second ring.

17. The apparatus of claim 16, wherein:

the first ring includes a tooth extending from a side of the first ring; and a groove formed in an adjacent end of the second ring, the tooth from the side of the first ring extends into the groove;

wherein the second ring has a second tooth circumferentially offset from the groove, the second tooth extending into a second groove formed in first portion.

* * * * *